United States Patent [19]

Bonnema et al.

[11] Patent Number: 5,000,620

[45] Date of Patent: Mar. 19, 1991

[54] ADJUSTABLE PIER SYSTEM

[76] Inventors: Mark W. Bonnema, 151 Cresent Dr., Grand Haven, Mich. 49417; Edward M. Schutt, 468 Circle Dr., North Muskegon, Mich. 49445; James C. Collins, 1435 Clarke Pl., South Haven, Mich. 49090; Stephen K. Babbitt, 125 E. 18th St., Holland, Mich. 49423

[21] Appl. No.: 503,521

[22] Filed: Mar. 27, 1990

[51] Int. Cl.[5] ..... E02B 3/20

[52] U.S. Cl. ..... 405/221; 182/146; 405/218

[58] Field of Search ..... 405/218–221; 114/266, 267; 182/146; 248/423

[56] References Cited

U.S. PATENT DOCUMENTS

| | | | |
|---|---|---|---|
| 71,791 | 12/1867 | Robinson | 182/146 X |
| 1,393,932 | 10/1921 | Andre | 182/146 X |
| 2,564,123 | 8/1951 | Melges et al. | 405/221 |
| 3,572,045 | 3/1971 | Owen | 405/221 X |
| 4,776,726 | 10/1988 | Viles | 405/221 |

FOREIGN PATENT DOCUMENTS

| | | | |
|---|---|---|---|
| 598528 | 5/1960 | Canada | 405/221 |
| 1434505 | 11/1968 | Fed. Rep. of Germany | 182/146 |

*Primary Examiner*—Dennis L. Taylor
*Attorney, Agent, or Firm*—Robert K. Wallor

[57] ABSTRACT

A plurality of longitudinally extending deck elements are each supported by transversely directed horizontal support rods at each end of each deck element. The rods are slidably removable through transversely aligned holes through vertical angle brackets paired to be adjacent the ends of the deck elements. The angle brackets are coupled at fixed elevations, relative to the water surface, to appropriately located pilings or bulkheads, and include a plurality of vertically spaced apart holes accepting the support rods at differing elevations. Brackets couple the end of the deck element to the corresponding support rod in a manner allowing some relative longitudinal displacement to allow for installation of the deck element as a ramp or to enable one end of the deck element to remain installed while the other end is adjusted to a different elevation. A portable hoist device which, in use, removably couples to, extends upwardly from, and spans, a transverse pair of the angle brackets such that its hoist depends centrally over the end of the deck element to be adjusted in elevation of the pier.

14 Claims, 2 Drawing Sheets

ADJUSTABLE PIER SYSTEM

BACKGROUND OF THE INVENTION

1. Field of the Invention

The present invention relates to pier and ramp systems that provide adjustable deck elevations relative to support uprights associated therewith, and more particularly to pier or ramp systems that are sectionally adjustable in elevation by a single user to include adjustments for sideways tilted and lengthwise mutually skewed orientations.

2. Description of the Prior Art

Pier systems have a long history of development, particularly through their usage as facilities for the mooring of small water craft. The most simple of such mooring concepts relies only on the availability of a beaching space for the craft. Added security against loss of the craft can be obtained by tying a painter from the craft to the nearest tree or sizable rock.

When it is not desired to beach the craft, simple finger piers have often been constructed to extend from the shoreline to a point whereat the depth of the water is sufficient to safely float the craft. Such pier constructions, in their most rudimentary form, comprise a plurality of planks laid end to end along a plurality of supporting structures independently extending upwardly from the bed of the body of water. This simple approach may be significantly improved, both in appearance and in durability, by having trestle structures formed to be vertical supports for a horizontal pier deck supporting member. A simple truss deck element is then installed to rest on the horizontal members of the vertical support trestles so as to span the separations between such trestle structures. The deck elements are then typically coupled to the trestle structures and to each other to enhance the composite structural integrity of the system.

Further developments, where permanent pier structures are feasible, include forming the vertical trestles as vertical pilings embedded into the bed of the body of water, or, in the alternative, forming the pilings as vertical concrete pillars supporting concrete decks coupled to, and spanning the separations between, such concrete pillars.

The aforesaid pier systems typically have a common feature of providing an upper surface of their deck elements at a predetermined elevation above the bed of the body of water rather than the water surface. In many bodies of water, however, the water surface level fluctuates from tidal action or, of more particular interest herein, from seasonal or multi-annual meteorologically associated climatic variations. As an example of the latter, the levels of the Great Lakes and directly connected bodies of water can vary several feet over the course of a year, and even greater variations arise when the changes in the mean water level are considered over a period of several years. Such variations can significantly affect the ease with which persons may access a craft moored at a pier having a deck at a fixed elevation relative to the bed of the body of water. Additionally, particularly in northern climes, permanently installed pier systems are at risk of severe damage from ice and winter storms.

Some of the pier systems described above are amenable to annual disassembly and removal for the winter months. Such systems may also be reassembled and installed so that their horizontal deck support members are at an appropriate elevation to accommodate the water surface level current at the time of installation of the pier system. However, such systems usually require significant effort to readjust their deck levels once they have been installed at a particular water level.

One alternative type of pier system that is not subject to such water level fluctuations can be found in floating pier systems. Such a system comprises, generally, a plurality of extended raft-like elements linked together to form a pier. The floating elements are typically held in horizontal location by vertical pilings having vertical bearing surfaces against which the floating deck elements may rise and fall with the water level. Since such floating systems are substantially restricted to fixed horizontal positions by the associated pilings, seasonal removal of the deck elements is exceedingly difficult, particularly if the combined structure has any sizable extent. Moreover, the typical proximity of the deck surface to the level of the water surface exposes the decks to ice and storm wave actions, although their floating nature may reduce this risk to some degree.

Among the above-described fixed pier systems, several versions have been devised that enable the individual deck elements to be removed so that their horizontal supports may be adjusted to a different elevation on their respective trestle structures. The deck elements are then reinstalled. It is believed to be typical of such systems that to accomplish such adjustments in elevation, several persons and heavy lifting equipment are usually required.

SUMMARY OF THE INVENTION

Accordingly, it is an object of the present invention to provide a pier system wherein the deck elements may be readily adjusted in elevation relative to their supporting trestle structures.

It is another object of the present invention to provide a pier system wherein such elevation adjustments may be performed by an individual user.

It is an additional object of the present invention to provide a pier system wherein horizontal support means are adapted to enable pier sections to be angled from side to side and from end to end.

It is a further object of the present invention to provide a pier system wherein the deck elements may be adjusted to have their respective ends at differing elevations so as to form a ramp.

Another object of the present invention is to provide a pier system wherein the trestle structures are adapted to accept and support a portable hoisting device for use in adjusting deck elevations.

An additional object of the present invention is to provide a durable, adjustable, pier system having an aesthetically pleasing appearance.

A further object of the present invention is to provide an adjustable pier system having minimal costs of manufacture and installation.

These, and other objects, features, and advantages of the present invention are provided by a pier system comprising a plurality of vertical trestle structures resting on or embedded in the bed of a body of water, a plurality of simple truss deck elements spanning the respective separations between trestle structures, and a portable hoisting device removably couplable to either of the trestle structures.

Each trestle structure is, in the preferred embodiment, fabricated of a pair of vertically extending members, parallelly spaced apart by a distance commensurate with accepting the width of a deck element therebetween. A horizontal separation and stabilizer brace element may be rigidly coupled between lower ends of the pair of vertical members. The vertical extent of the trestle structure is generally adapted for local conditions at the site of installation, such as water depth, and for the manner of installation of the trestle structures to be accomplished. The vertical members are typically formed of angle stock, although channel stock may be employed. In the angle stock form of the invention, the angle stock is oriented to have one leg of the L-shape of each vertical member mutually coplanar, with the other legs of the L-shape of each vertical member extending mutually parallelly in the same horizontal direction. The parallel legs are preferred to be mutually proximate in a given trestle structure.

In order to simplify fabrication of the trestle structures, the preferred installation is to first install pilings at the appropriate positions, and to then affix the trestle structures to the corresponding pairs of pilings, or to bulkheads thereat, at the desired elevations thereon. To accommodate such installation, the aforesaid coplanar legs of the L-shape of the vertical members are provided with a plurality of vertically spaced apart holes through which attachment means may be placed to secure the vertical elements to the pilings. Similarly, the mutually parallel legs of the L-shape of the vertical members are provided with a differing plurality of vertically spaced apart holes. These holes are to be in horizontally paired registration between the two vertical members of a pair, and are typically vertically spaced apart by nine inches, the distance of a typical stair step. Such holes are intended to accommodate the horizontal support means for the deck elements, as will be further described hereinbelow.

The horizontal spacing between pairs of pilings or between trestle structures is that of the length of the deck element to be supported therebetween. Trestle structures supporting adjacent ends of a pair of longitudinally deployed deck elements are spaced in close mutual proximity. That is, a trestle structure is generally required at least at each end of each deck element. However, it is equally appropriate to adapt one end of the deck element to be coupled by a hinge to the trestle-supported adjacent end of the adjacent deck element.

While deck elements may be formed of any appropriate material, such as wood, metal, or concrete, the deck elements are typically formed of cast lightweight materials, such as acrylics or fiber glass, which may be wood filled, having a length in the intended direction of the extent of the pier, a width horizontally orthogonal to the extent of the pier, and a thickness in the vertical direction. Additional structural integrity is provided by integrally casting a substantial downwardly depending flange lengthwise along the extent of each width edge of the deck element. A pair of horizontal support brackets are affixed to the lower ends of the depending flanges respectively proximate to each end of the extent of the deck element. Each such horizontal support bracket extends transversely of the extent of the deck element. It is also envisioned that some existing pier systems may be retrofitted to be supported by the trestles of the present invention.

When the deck element is emplaced to have its lengthwise ends between respective trestle structures, a support rod is passed through the appropriate deck elevation hole of one of the vertical members of the trestle, thence through the horizontal support bracket of the deck element, and lastly through the corresponding deck elevation hole of the other vertical member of the trestle structure. When the support rod extends through both holes in the vertical members of the trestle structure, it is secured in place, typically by passing a cotter pin through a hole formed transversely through each end of the rod. The horizontal support bracket includes a pair of means for angularly adjusting the deck element relative to the support rod, and for locking the deck element thereto in position. These locking means are disposed to be proximate to the width edges of the horizontal support bracket.

If additional structural integrity is deemed necessary, diagonally extending corner braces may be placed to extend from approximately the central portion of the horizontal support bracket to respective vertical members of the trestle structure at elevations below the deck.

A portable hoisting device is incorporated in the present invention to enable an individual user to readjust the deck elevation as desired. The hoisting device consists, generally, of a standard chain fall hoist supported from an eye hook cantilevered from a horizontal beam member extending transversely of the extent of the pier, the beam member being held above the deck, proximate to each end of the beam member, by a pair of vertical support posts. The vertical support posts are respectively adapted, at their lower ends, to removably, rigidly couple to uppermost end portions of the pair of vertical members forming a trestle structure. The coupling of the vertical support posts to the beam member is accomplished in a manner enabling the horizontal separation between the vertical support posts to be varied in accordance with the width of the pier trestle structure at which the deck elevation is to be adjusted.

When deck elevation adjustment is desired, the portable hoisting device is coupled to the desired trestle structure. An appropriately sized lift strap is then placed around the under side of the deck element, transversely to the extent of the deck element, with the ends of the strap being brought together at the lowered hook of the chain fall device. The chain fall is then operated to lift the end of the deck element sufficiently to enable the locking devices on the lower side of the horizontal support bracket to be loosened, the cotter pins removed from the support rod, and the rod withdrawn from the holes in the vertical members of the trestle structure and from the horizontal support bracket. The chain fall may then be operated appropriately to raise or lower the end of the deck element to the desired elevation whereat the support rod is inserted through the corresponding holes in the vertical members of the trestle structure and the horizontal support bracket, and is then secured in place. The chain fall is then lowered to enable the lift strap to be removed. The hoisting device may then be removed and placed at the next trestle structure whereat a deck elevation adjustment is to be performed. The aforesaid operations are then repeated until all deck elevation adjustments have been accomplished, at which time the portable hoisting device may be removed to a place for storage thereof It is to be noted that the elevation adjustments may be performed while the individual user is standing on the deck element being raised or lowered.

Implicit in the foregoing descriptions is the feature that a given deck element may be emplaced to have its respective longitudinal ends at differing elevations. A ramp may thus be formed by having a next sequential deck element match the elevation of the adjacent end of the first deck element, with the obverse end of the second deck element being placed at a third elevation. Alternatively, a first deck element may be emplaced at a given horizontal elevation while the second deck element is emplaced at a differing, by one step increment, horizontal elevation so as to form a stairway like composite structure.

While the foregoing has referred exclusively to pier systems, it is envisioned that the trestle and deck element combination could be emplaced on land, in its ramp arrangement, to serve as a semi-permanent means of access for handicapped persons to buildings and the like. Additionally, the foregoing has not discussed several amenities that may be noted in reference to the accompanying drawing. While such features are shown and described in the following detailed descriptions, they are not essential to a pier system in accordance with the present invention.

BRIEF DESCRIPTION OF THE DRAWING

In the accompanying drawing, wherein like reference numerals and symbols are used to identify like elements throughout.

DETAILED DESCRIPTION OF THE PREFERRED AND ALTERNATE EMBODIMENTS

Figure 1:
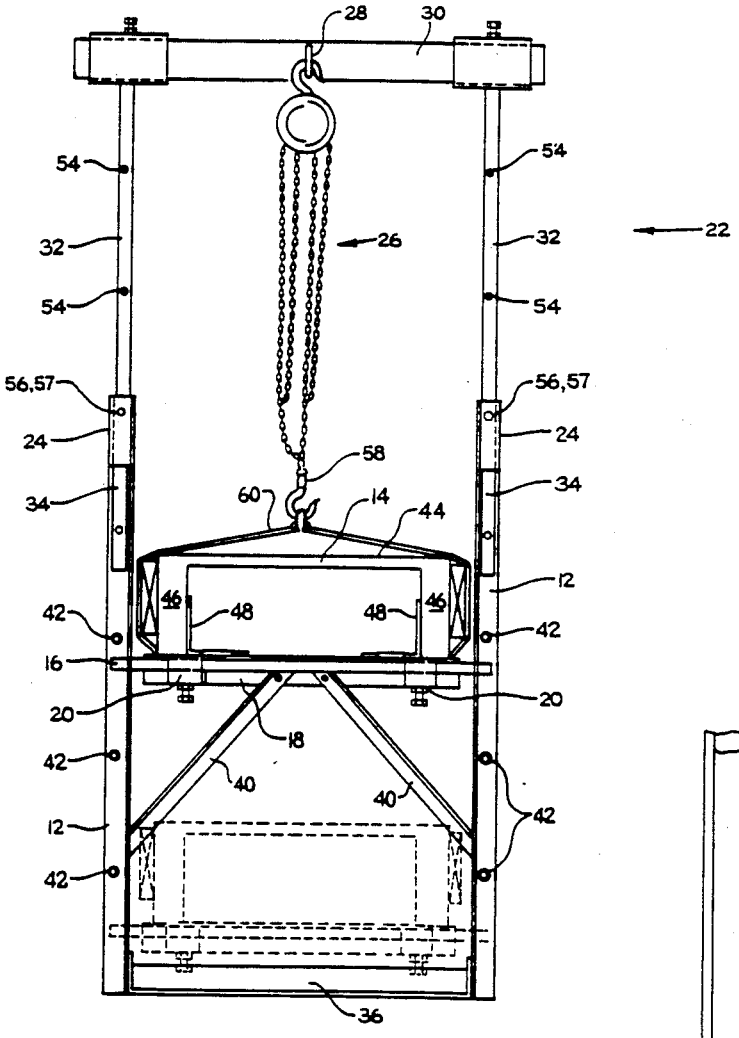
FIG. 1 presents a generally horizontal view along the extent of a pier in accordance with the present invention.

Referring first to FIG. 1, an end view along the length of a pier in accordance with the present invention, said pier system being indicated generally at 10, illustrates the combination of component elements and subsystems in their typically assembled configuration. The pier system 10 can be noted to include a pair of vertical angle bracket members 12 spaced apart to accommodate a width of a deck element 14 therebetween, like pairs of vertical angle bracket members 12 being disposed appropriately along the length of the pier system 10, particularly at locations corresponding to each end of each length section of deck elements 14 used in constructing such a pier system 10. Each such pair of vertical angle bracket members 12 forms an equivalent trestle structure for supporting an end of a deck element 14. The deck element 14 is supported on a substantially horizontal support rod 16 extending through horizontally registering holes through the pair of vertical angle bracket members 12. The horizontal support rod 16 also extends through a horizontal support bracket 18 spanning the width of the deck element 14 proximate to its longitudinal end, which horizontal support bracket 18 is rigidly coupled to the under side of the deck element 14. Fastening and angular adjusting subsystems 20 are included to removably couple the support bracket 18 to the support rod 16. A like arrangement is present at each end of each deck element 14.

When the elevation of the end of the deck element 14 is to be adjusted, a portable hoisting device. indicated generally at 22, is rigidly, but removably, coupled to upper portions 24 of the vertical angle bracket members 12. The portable hoisting device 22 comprises a standard chain fall device 26 depending from an eye hook 28 cantilevered from a horizontal transverse support beam 30. The transverse support beam 30 rests on, and is coupled to, a pair of vertical support posts 32 adapted at their lower ends 34 to be coupled to the upper end portions 24 of the vertical angle bracket members 12.

Each of the vertical angle bracket members 12 is provided with a plurality of vertically spaced apart holes 42 therethrough, in a direction generally oriented with the longitudinal extent of the pier system 10. These holes 42 provide for a like plurality of rigid attachment points to a vertical piling or bulkhead (not illustrated) in order to support the vertical angle bracket members 12 at their desired elevations. Alternatively, the vertical angle bracket members 12 may be welded along appropriate portions of their vertical extent to appropriate pilings or bulkheads. The aforesaid pilings or bulkheads are considered to be in place at the locations whereat the pier system 10 in accordance with the present invention is to be emplaced, and are therefore not considered as part of the present invention. However, if such pilings or bulkheads are not in place, they must be appropriately installed prior to the erection of the herein pier system 10.

While not essential to the preferred embodiment of a pier system 10 in accordance with the present invention, additional structural integrity may be provided to the combination by the inclusion of a horizontal separation and stabilizer brace 36 rigidly coupled between the lowermost ends 38 of the vertical angle bracket members 12. Further strength may be attained by rigidly coupling a pair of corner braces 40 to extend downwardly diagonally from a central portion of the horizontal support bracket 18 to the respective vertical angle bracket members 12 at an elevation below that of the horizontal support rod 16.

Figure 2:
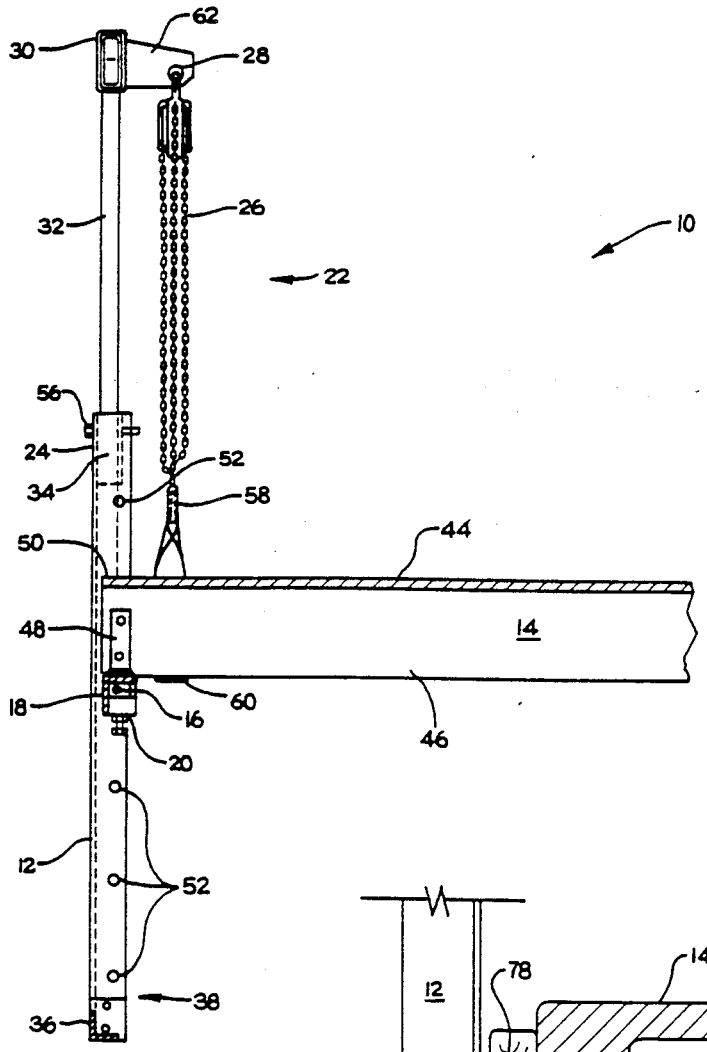
FIG. 2 presents a fragmentary side cross-sectional view of a pier in accordance with the present invention.

Referring next to FIG. 2, showing a fragmentary side view of the pier system 10 as indicated by the view plane 2—2 in FIG. 1, the deck element 14 can be seen to be an integrally formed unit having a deck surface 44 having a thickness in a vertical direction and a substantial depending flange portion 46. As can be noted in FIG. 1, a flange portion 46 is formed to each side of the width of the deck element 14. These flange portions 46 serve as simple truss elements for the longitudinal spa extent between successive pairs of vertical angle bracket members 12 supporting obverse ends of the deck element 14. The horizontal support bracket 18 is coupled to the flange portions 46 by brackets 48. It is to be noted that the horizontal support bracket 18 is disposed in close proximity to the end 50 of the deck element 14. A flat deck element can be similarly accommodated by replacing the brackets 48 with screws to couple the deck element directly to the horizontal support bracket 18.

The planar portion of the vertical angle bracket 12 extending in the plane of FIG. 2, that is, extending in the direction of the longitudinal extent of the deck element 14, is provided with a plurality of vertically spaced apart holes 52, each formed to freely accept the horizontal support rod 16 therethrough. These holes 52 are typically vertically spaced apart by approximately nine inches on centers, which distance represents the standard rise of a stairway step. The holes 52 in one of the pair of vertical angle bracket members 12 supporting an end 50 of the deck element 14 are constrained to be in horizontal registration with the holes 52 in the other vertical angle bracket member 12 of the pair. The holes 52 are further constrained to be in substantial horizontal registration for all said trestle structures.

The portable hoisting device 22 can be seen to be so adapted that the lower ends 34 of the vertical support posts 32 telescopically mate within channels formed at the upper ends 24 of the vertical angle bracket members 12. As can be noted in FIG. 1, the vertical support posts 32 are provided with a plurality of vertically spaced apart holes 54 therethrough in horizontal directions along the longitudinal extent of the pier system 10. FIG. 2 illustrates that each of the vertical support posts 32 are held at an appropriate elevation relative to the upper ends 24 of the vertical angle bracket members 12 by a pin 56 passing through a hole 57 in the vertical angle bracket member 12 near its upper end 24, through one of the holes 54 in the corresponding vertical support post 32, and through a correspondingly aligned hole through the channel at the upper end 24 of the vertical angle bracket member 12.

When the portable hoisting device 22 is so emplaced, the chain fall device 26 may be appropriately operated to lower a hook 58 carried thereon to enable a strap 60 to be passed from the hook 58, around the under side of the deck element 14, and back to the hook 58. Appropriate operation of the chain fall device 26 then enables the end 50 of the deck element 14 to be held to allow the support rod 16 to be withdrawn. The end 50 of the deck element 14 may then be either raised or lowered by operation of the chain fall device 26 to align the end 50 of the deck element 14 appropriately with another pair of holes 52 in the vertical angle bracket members 12 at the desired adjusted elevation of the end 50 of the deck element 14. It should be noted that the strap 60 is positioned away from the end 50 of the deck element 14 in order to provide clearance enabling the individual user to reach below the surface level 44 of the deck element 14 to grasp and withdraw the horizontal support rod 16 and to accomplish its subsequent reinsertion. This separation in the position of the strap 60 is accomplished by providing a horizontal bracket 62, rigidly coupled to substantially the mid-point of the horizontal support beam 30, to cantilever the vertical position of the eye hook 28 from which the chain fall device 26 depends.

Figure 3:
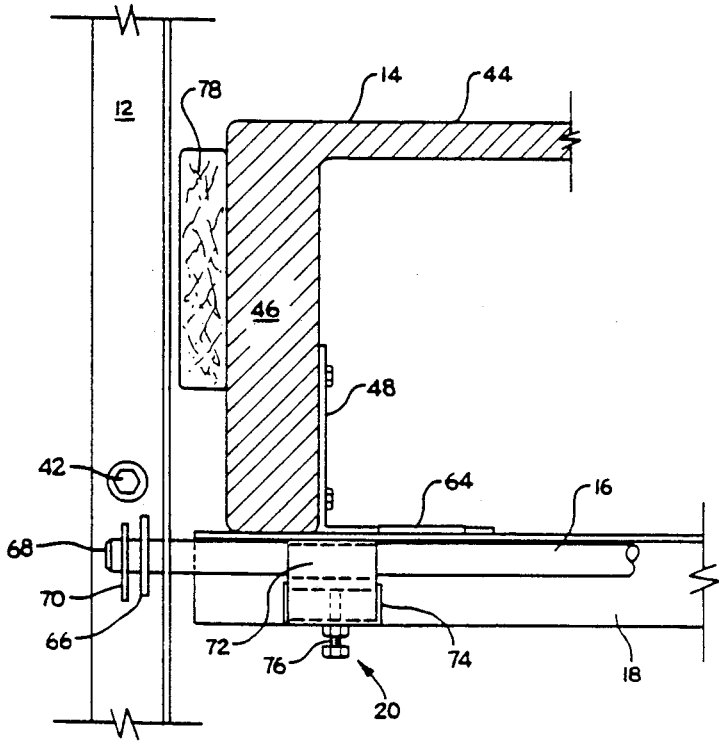
FIG. 3 is a fragmentary cross-sectional view illustrating the coupling of a deck element to a vertical member of a trestle structure for a pier in accordance with the present invention, as seen along an extend of such a pier.

Referring next to FIG. 3, the assembly of a deck element 14 to its associated horizontal support bracket 18, utilizing the bracket 48, the support of the horizontal support bracket 18 by the horizontal support rod 16, the coupling of the horizontal support rod 16 to the vertical angle bracket member 12, and the locking of the horizontal support bracket 18 to the horizontal support rod 16 by the locking device 20, are shown in greater detail. One leg of the bracket 48 can be seen to be coupled to the lower portion of the inwardly facing surface of the flange portion 46 of the deck element 14, while the other leg of the bracket 48 is coupled to an upper surface of the horizontal support bracket 18 by a guide 64 affixed to the upper surface of the horizontal support bracket 18. The coupling of the bracket 48 to the guide 64 provides for angular adjustment of the horizontal orientation of the deck element 14. That is, the alignment of the deck element 14 in its longitudinal extent may be adjusted angularly about a vertical axis through the end of the deck element 14 proximate to the horizontal support bracket 18.

The horizontal support rod 16 is retained in its installed position supporting the deck element 14 by a washer 66 placed around the support rod 16 at its end 68 projecting through the hole 52 in the vertical angle bracket member 12 and a cotter pin 70 engaged through a hole formed transverse to the extent of the support rod 16 further proximate to its projecting end 68. A like arrangement of a washer 66 and a cotter pin 70 is employed at the obverse end 68 of the horizontal support rod 16 projecting through a corresponding hole 52 in the other vertical angle bracket member 12 of the pair disposed to support the end of the deck element 14.

The transverse position of the deck element 14 relative to the vertical angle bracket members 12 is, after all adjustments have been accomplished, maintained by a pair of locking devices 20, respectively disposed along the extent of the horizontal support bracket 18 proximate to the vertical positions of the flanges 46 of the deck element 14. Each locking device 20 consists of a locking channel element 72 constrained to operate in a substantially vertical direction within a guide box 74 attached to the horizontal support bracket 18 by a vertically acting locking bolt 76. When the locking bolt 76 is fully engaged with the guide box 74, the locking channel element 72 is forced against the support rod 16, thereby frictionally precluding transverse motion of the horizontal support bracket 18, and the supported deck element 14 coupled thereto, relative to the support rod 16. The positioning of the locking devices 20 enables an individual user to reach under the deck element 14 to operate the locking bolts 76 while the user is situated on the deck surface 44.

As a matter of convenience for the use of a pier system 10 in accordance with the present invention, the outwardly appearing vertical surfaces of the flange portions 46 of the deck elements 14 may be equipped with rub boards 78 attached thereto along their respective longitudinal extents.

Figure 4:
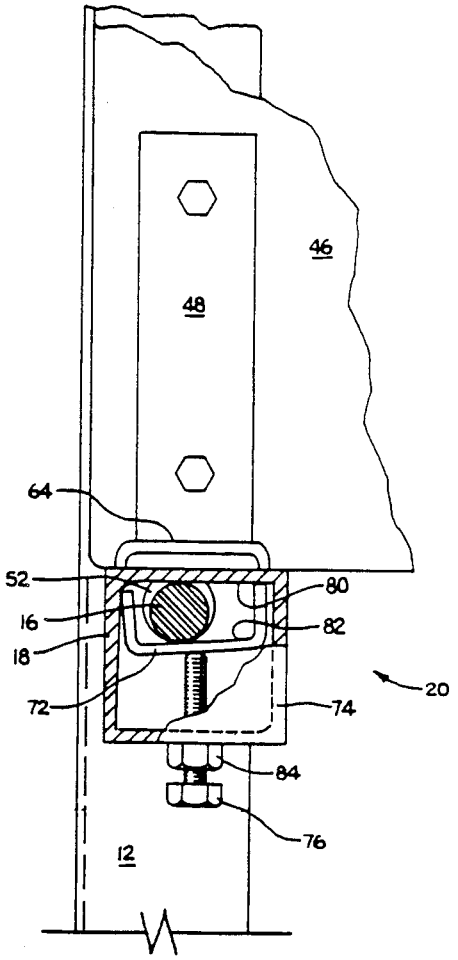
FIG. 4 is a fragmentary cross sectional side view of a locking and angular positioning subsystem of a pier in accordance with the present invention.

Referring lastly to FIG. 4, the functional detail of the locking device 20 can be observed. When the locking bolt 76 is fully engaged with threads formed in a hole through a lower surface of the guide box 74 affixed to the horizontal support bracket 18, the locking channel element 72, having legs that are shorter than the diameter of the support rod 16, locks the support rod 16 between a lower surface 80 of the horizontal support bracket 18 and an upper surface 82 of a web portion of the locking channel element 72. In the illustrated configuration of FIG. 4, a measure of eccentricity is shown to indicate that the side of the deck element 14 depicted has been positioned to the illustrated right direction of its nominal horizontal angular alignment. The variably constructed width of the locking channel element 72 allows for raising one end of the deck element 14 by several feet without the need to remove the support rod 16 at the obverse end of the deck element 14. The measure of eccentricity of the locking channel element 72 is determined by the length of the deck element 14 and the demand for raising or lowering the dock such that the diameter of the support rod 16 will, when the locking devices 20 are loosened, allow translation of the deck element 14 along its extent sufficiently to accommodate such severe variation in elevation of the obverse end of the deck element 14. The illustration shows the manner in which the deck element 14 is locked into a position wherein the longitudinal alignment of the deck element 14 is rotated clockwise, when viewed vertically from above, about a vertical axis through that end of the deck element 14. In such a configuration, the locking channel element 72 within the locking device 20 at the obverse end of the support rod 16 would typically assume an opposed eccentric orientation. In either condition of eccentricity, motion of the support rod 16 toward an illustrated left direction of FIG. 4 is precluded by bearing of the support rod 16 against the circumference of the hole 52 in the vertical angle bracket member 12. Further locking security of the assembly can be assured through the inclusion of a lock nut 84 on the locking bolt 76.

With reference to the drawing as may be necessary and appropriate, a pier system 10 in accordance with the present invention may be initially installed through performance of the following operations. The locations of the ends of lengths of deck elements 14 necessary to the assembly of the desired pier system are determined and appropriate pilings or bulkheads are emplaced accordingly, if such pilings or bulkheads are not already present. Such pilings or bulkheads are, of course, disposed in pairs, each pair being spaced apart to accept the width of a deck element 14. A pair of vertical angle bracket members 12 are then rigidly affixed, respectively to the corresponding piling or bulkhead at the location of the end of the deck element 14. Another pair of vertical angle bracket members 12 are similarly affixed to the pilings or bulkheads located at the other end of the length of the deck element 14. Both pairs of vertical angle brackets 12 are affixed to their respective pilings or bulkheads in a manner such that their respective elevations correspond to the desired range of deck elevations intended for the installation. The affixing of the vertical angle brackets 12 is further constrained to be such that the holes 52 available for accepting the horizontal support rods 16 form sets that are horizontally mutually coplanar. A piling or bulkhead that is placed to be intermediate between two adjacent lengths of deck elements 14, at their common ends, will require the affixation of two pairs of vertical angle bracket members 12, one pair to accept and support the end of the first deck element 12 and the other pair to accept and support the adjacent end of the second deck element 14.

The portable hoisting device 22 is then emplaced on the upper ends of the first pair of vertical angle bracket members 12 such that the horizontal bracket 62 extends in a direction toward the second pair of vertical angle bracket members 12. The chain fall device 26 is then operated to lower the hook 58 sufficiently to enable the strap 60 to be passed beneath the end of a deck element 14 carried by a floating support (not illustrated) positioned below the intended assembled position. The chain fall device 26 is then operated to raise the end of the deck element 14 to its intended elevation whereat a support rod 16 is passed transversely through the appropriate hole 52 in the first of the pair of vertical angle bracket members 12, through and beneath the horizontal support bracket 18 at that end of the deck element 14, ensuring that the support rod 16 passes through the pair of locking devices 20 en route, and thence through the corresponding hole 52 in the other vertical angle bracket 12 of the pair. The ends 68 of the horizontal support rod 16 are then secured in longitudinal translational position by installing a washer 66 and cotter pin 70 at each end 68.

The portable hoisting device 22 is then disengaged from the first end of the deck element 14, and is removed from the first pair of vertical angle bracket members 12. It is then emplaced to be coupled atop the second pair of vertical angle bracket members 12 such that the horizontal bracket 62 extends toward the first end of the deck element 14. The chain fall device 26 is then appropriately operated to enable the strap 60 to be passed beneath the second end of the deck element 14 and to then raise the second end of the deck element 14 to its intended elevation whereat a second horizontal support rod 16 is transversely installed in the manner described for the first horizontal support rod 16. The deck element 14 is then adjusted in angular alignment and the locking bolts 76 of each locking device 20 are tightened to hold the deck element 14 in position.

A second and subsequent lengths of deck elements 14 may be similarly installed by relocating the portable hoisting device 22 and repositioning the floating support for the uninstalled deck elements 14 accordingly. Upon completion of the installation of all deck elements 14, the portable hoisting device 22 is removed from its final pair of vertical angle bracket members 12 and stored appropriately for future use. It should be noted that the initial (and subsequent) installations of the dock may be accomplished by the use of an independent crane, in lieu of the portable hoisting device 22, to lower the deck elements 14 onto the horizontal support bracket 18 from above.

From the preceding description of the process of installing a pier system 10 in accordance with the present invention, disassembly of a pier system 10 in accordance with the present invention can be readily accomplished by positioning the portable hoisting device 22 over a first end of the deck element 14 to be removed, engaging the strap 60 to the hook 58 so that the strap 60 passes beneath the end of the deck element 14, lifting the end of the deck element 14 sufficiently to take the weight off the support rod 16, loosening the locking devices 20 at both ends of the deck element 14, removing the cotter pin 70 and washer 66 from at least one end 68 of the support rod 16, removing the horizontal support rod 16 from the end of the deck element 14 supported by the portable hoisting device 22, and then lowering the freed end of the deck element 14 to a floating support positioned therebeneath. The other end of the deck element 14 is then similarly freed so that it may be floated to seasonal storage or for repair, as may be desired or necessary.

It may be further clearly observed that adjustment in the elevation of a deck element 14 is accomplished by following the disassembly procedure through the step of freeing the end of the deck element 14 so that it may be lowered At that stage, the deck element 14 may be either lowered or raised to a new elevation whereat the horizontal support rod 16 is reinstalled appropriately. The other end of the deck element 14 is then brought to a new desired elevation in a like manner.

While the foregoing detailed descriptions have, in so far as they address an installed pier system 10, considered systems in which the elevations of all deck elements 14 are substantially horizontal, it is envisioned herein that deck elements 14 may be installed so as to form a ramp merely by having the horizontal support rod 16 supporting a second end of a deck element 14 installed through corresponding holes 52 of the pair of vertical angle bracket members 12 located at the second end at an elevation that differs from the elevation of the corresponding holes 52 through the pair of vertical angle bracket members 12 at the first end of the deck element 14. Indeed, it is envisioned that a pier system 10 may be installed such that a first segment or deck element 14 form a horizontal surface, a third segment or deck element 14 be installed at a different horizontal elevation, with a second, intermediate, deck element 14 being installed as a ramp with one end at the elevation of the first segment and the other end at the elevation of the third segment. Such combinations appear to be limited only by the intended use of a pier system 10 in accordance with the present invention.

It is further envisioned that the present system may, while primarily conceived for use as a pier system, be emplaced on land as a catwalk or as a ramp system for handicapped access to buildings and the like. A further application of the present system is to have sequentially adjacent deck elements 14 each horizontally disposed at different elevations that differ by one standard stair step vertical distance, thereby forming a stairway having long treads with standard rises.

While the foregoing descriptions have considered a preferred and alternate embodiments of a pier system in accordance with the present invention, it is further envisioned that additional embodiments may become obvious to those skilled in the art through the herein disclosures. Such as may be beyond the realm of mere design choice are therefore considered to be within the spirit of the present invention as limited only by the scope of the appended claims.

We claim:

1. An elevation-adjustable pier system, comprising:

a plurality of vertical support columns supported upwardly from a bed of a body of water, said plurality being arranged in pairs spaced apart transversely of an extent of said pier substantially by a width of said pier, said pairs being horizontally spaced apart along an extent of said pier;

a plurality of vertically disposed angle brackets, each coupled to an appropriate one of said vertical support columns such that respective upper ends of each angle bracket are at substantially equal vertical elevations relative to an upper surface of said body of water, said angle brackets each including a plurality of vertically spaced apart holes therethrough so arranged as to be directed substantially transverse to the extent of the pier, said holes of each pair of angle brackets coupled, respectively, to said vertical support columns being in substantially horizontal mutual alignment;

a plurality of deck elements, each having a width appropriate to the horizontal spacing between vertical support columns of the pairs and an extent appropriate to the horizontal spacing between adjacent pairs of said vertical support columns, the extent of said deck elements defining ends of said deck elements;

means for removably, relocatably supporting each end of each deck element at an elevation above said water surface determinable by selection of an appropriate pair of transversely aligned holes through said angle brackets; and means for releasably locking each end of each deck element to its corresponding means for supporting each end of said deck elements.

2. The elevation-adjustable pier system of claim 1, wherein said means for removably, relocatably supporting each end of each deck element comprises, at each such end of each deck element, a horizontal support rod slidably passing through the selected transversely aligned holes such that the corresponding end of the corresponding deck element rests thereupon, said horizontal support rod being retained in such position by means, disposed at each end thereof, for retaining said rod in position spanning the separation between angle brackets of the corresponding pair, said horizontal support rod being slidably removable from said transversely aligned holes for reinsertion into transversely aligned holes at a differing elevation when said end of said deck element has been adjusted to a differing elevation.

3. The elevation-adjustable pier system of claim 2, wherein said means for releasably locking each end of each deck element to its corresponding horizontal support rod comprises, at each such end of each such deck element, at least two brackets rigidly coupled to a lower surface of said deck element in a transversely spaced apart arrangement proximate to the end of said deck element, each said bracket including a hole therethrough directed to be substantially transverse to the extent of the deck element, said hole slidably accepting said horizontal support rod therethrough.

4. The elevation-adjustable pier system of claim 3, wherein each bracket rigidly coupled to the lower surfaces of the deck elements further comprises means for clamping said bracket to its corresponding, appropriately inserted, horizontal support rod.

5. The elevation-adjustable pier system of claim 4, wherein said holes through said brackets rigidly coupled to lower surfaces of said deck elements are each formed to have an elongated eccentric extent in the direction of the extent of the deck elements, said elongation enabling opposed ends of a particular deck element to be at differing elevations while maintaining a constant horizontally projected separation distance between horizontal support rods disposed at each end of said deck element.

6. The elevation-adjustable pier system of claim 5, wherein opposed ends of a deck element thereof are supported by their respective horizontal support rods which are slidably passed through transversely aligned holes of their corresponding vertically disposed angle brackets at elevations that differ between opposed ends of the deck element, thereby causing the deck element to be oriented as a ramp.

7. The elevation-adjustable pier system of claim 5, wherein an end of a first deck element is supported by its corresponding horizontal support rod at a first elevation on the corresponding pair of transversely disposed vertically oriented angle brackets and an abutting end of a second deck element is supported by its corresponding horizontal support rod at a second elevation on its corresponding pair of transversely disposed vertically oriented angle brackets so as to form a step when crossing from the first deck element to the second deck element.

8. The elevation-adjustable pier system of claim 1, further comprising:

a pair of upwardly extending vertical support posts;

a transverse beam member, having a horizontal extent greater than the width of said pier;

means for coupling upper ends of said vertical support posts to said transverse beam member such that said vertical support posts are respectively proximate to opposed ends of said transverse beam member, said means allowing variation in the positioning of said coupling so that said vertical support posts may be appropriately horizontally spaced apart to match the horizontal separation between vertical angle brackets of a transversely disposed pair;

means for removably coupling lower ends of said vertical support posts to corresponding upper ends of said pair of vertically disposed angle brackets such that said transverse beam member is supported substantially transverse to the extent of said pier substantially directly above a corresponding end of a deck element;

a hoist device depending from an approximate midpoint of the extent of said transverse beam member; and means for coupling a lower end of said hoist device to the correspondingly proximate end of the deck element such that operation of said hoist device will accordingly tend to raise or lower the so attached end of the deck element to enable appropriate removal, adjustment, or insertion of the corresponding means for supporting the end of the deck element;

said vertical support posts, transverse beam member, hoist device, and means for coupling a lower end of said hoist device to an end of a deck element forming an assembly that is relocatable to any desired transversely disposed pair of vertical angle brackets at which a change at elevation of the corresponding end of a deck element is to be accomplished, said assembly further being removable from said pier when such adjustments have been completed.

9. In a pier system having a plurality of pilings and bulkheads disposed so as to define corner locations of pier elements, the improvement comprising:

a plurality of vertical angle brackets, respectively coupled to said pilings and bulkheads so as to form pairs of vertical angle brackets, each pair being aligned transverse to the extent of the pier and spaced apart thereat; said coupling to said respective pilings and bulkheads being accomplished in a manner such that upper ends of each angle bracket are at substantially the same elevation above a water surface;

a plurality of vertically spaced apart holes through each of said angle brackets, said holes being oriented to extend substantially transverse to the extent of the pier and, further, to be formed as mutually horizontally aligned pairs;

at least one deck element configured to have a width approximating, but less than, the separation between angle brackets of each pair, and a length substantially equal to a horizontal separation between adjacently positioned pairs of angle brackets, said length defining opposed ends of the deck element, similarly configured deck elements being provided for each additional set of angle brackets along the extent of said pier;

means, removably and relocatably coupled between each vertical angle bracket of each transversely disposed pair, for supporting a corresponding end of the deck element; and means for releasably locking the deck element, at each end thereof, to said means for supporting a corresponding end of the deck element.

10. The improvement as claimed in claim 9, wherein said means for supporting a corresponding end of the deck element comprises:

a horizontal support rod having a length sufficient to span the separation between vertical angle brackets of a transverse pair thereof, said horizontal support rod being configured to be slidably inserted along its length through a selected pair of horizontally aligned, transversely directed, holes through the pair of angle brackets at a desired elevation above the water surface; and means for releasably securing said horizontal support rod to preclude longitudinal translation thereof;

said corresponding end of said deck element resting on and being supported by said horizontal support rod.

11. The improvement as claimed in claim 10, wherein said means for releasably locking the deck element, at each end thereof, to said means for supporting a corresponding end of the deck element comprises, for each end of the deck element:

at least two coupling brackets rigidly coupled to the deck element in a transversely spaced apart arrangement proximate to the end of the deck element thus supported and locked, said coupling brackets depending equally below said deck element, each coupling bracket having a hole formed therethrough in a direction transverse to the extent of the pier, said holes being in substantially horizontal transverse alignment accepting engagement with said horizontal support rod slidably passed longitudinally therethrough; and means for clamping said coupling brackets to said horizontal support rod.

12. The improvement as claimed in claim 9, wherein said means for supporting an end of the deck element comprises a hinge linking the supported end of the deck element with the pier element next proximate thereto in the direction of the extent of the pier.

13. The improvement as claimed in claim 9, further comprising:

means, removably attachable to a selected transversely disposed pair of vertical angle brackets, for supporting an end of the deck element at an operably variable elevation;

said means being disposed, when attached to said angle brackets, to extend substantially vertically over said end of said deck element;

operation of said means accordingly tending to raise or lower the end of the deck element to enable elevation adjustment of the means for supporting said end of said deck element.

14. The improvement as claimed in claim 13, wherein said means for supporting an end of the deck element at an operably variable elevation comprises:

an upwardly extending adjustable frame constructed to span the width of the pier between vertical angle brackets of a transversely disposed pair;

a hoist device depending substantially centrally from an upper extent of said frame; and a strap coupling a lower, variable elevation, end of said hoist device to said end of said deck element

* * * * *